US006499975B2

(12) United States Patent
Ota et al.

(10) Patent No.: US 6,499,975 B2
(45) Date of Patent: Dec. 31, 2002

(54) MEANS FOR SEALING THE CYLINDER BORE OF A VARIABLE DISPLACEMENT COMPRESSOR WITHOUT USING A VALVE PLATE

(75) Inventors: Masaki Ota, Kariya (JP); Tomoji Tarutani, Kariya (JP); Tomohiro Wakita, Kariya (JP); Taku Adaniya, Kariya (JP); Ryo Matsubara, Kariya (JP); Yoshikazu Fukutani, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/829,699

(22) Filed: Apr. 10, 2001

(65) Prior Publication Data

US 2001/0028856 A1 Oct. 11, 2001

(30) Foreign Application Priority Data

Apr. 11, 2000 (JP) ..... 2000-109864

(51) Int. Cl.[7] ..... F04B 39/10

(52) U.S. Cl. ..... 417/571; 417/222.2; 417/269

(58) Field of Search ..... 417/222.2, 222.1, 417/269, 571

(56) References Cited

U.S. PATENT DOCUMENTS

| | | | | | |
|---|---|---|---|---|---|
| 1,435,973 | A | * | 11/1922 | Pelletier | 417/571 |
| 3,146,940 | A | * | 9/1964 | McCrory et al. | 417/571 |
| 5,518,376 | A | * | 5/1996 | Haraoka | 417/571 |
| 5,718,517 | A | * | 2/1998 | Rozek | 417/571 |
| 6,224,349 | B1 | * | 5/2001 | Iwanami et al. | 417/269 |
| 6,334,759 | B1 | * | 1/2002 | Kaneko et al. | 417/222.2 |

FOREIGN PATENT DOCUMENTS

| | | |
|---|---|---|
| JP | 5-1872 | 1/1993 |
| JP | 5-106559 | 4/1993 |
| JP | 5-332249 | 12/1993 |

* cited by examiner

*Primary Examiner*—Cheryl J. Tyler
(74) *Attorney, Agent, or Firm*—Morgan & Finnegan, LLP

(57) ABSTRACT

A variable displacement compressor 10 includes a wall 1*a* that seals a cylinder bore 14, and is integrally formed with a cylinder block 1. A rear plate 5 having a plate-like shape is fastened via a gasket 6 to a location that extends to the inner rear side of a wall 1*a*. Suction valves 40 and discharge valves 44 are disposed within the wall 1*a*.

5 Claims, 4 Drawing Sheets

MEANS FOR SEALING THE CYLINDER BORE OF A VARIABLE DISPLACEMENT COMPRESSOR WITHOUT USING A VALVE PLATE

BACKGROUND OF THE INVENTION

1. Field of the Invention

The present invention relates to compressors that may preferably be used in automotive air conditioning systems and other devices.

2. Description of Related Art

As one type of known compressors, a variable displacement compressor is disclosed in U.S. Pat. No. 5,873,704 and is typically used in automotive air conditioning systems. The variable displacement compressor changes the compressor output discharge capacity by changing the pressure within a crank chamber that includes a swash plate. The swash plate is coupled to a drive shaft and rotates together with the drive shaft. The swash plate changes the inclination angle with respect to the plane perpendicular to the axis of the drive shaft. A cylinder block includes a valve plate that covers the cylinder bore and a rear housing is disposed on the rear side of the cylinder block. The rear housing contains a suction chamber and a discharge chamber for the refrigerant. The valve plate and the rear housing are fastened to the cylinder block by a gasket and fastening bolts attached to the adjoining surfaces.

Because known compressors require the valve plate and a plurality of gaskets on the rear side of the cylinder block, a large number of parts are required and the manufacturing cost is naturally influenced by this requirement. Moreover, the cylinder bore sometimes deforms due to the fastening force applied to the fastening bolts when the valve plate and rear housing are fastened to the cylinder block using the fastening bolts.

SUMMARY OF THE INVENTION

It is, therefore, an object of the present invention to provide improved compressors.

In one aspect of the present teachings, compressors are taught that minimize the number of parts in view of known compressors. By minimizing the number of parts, manufacturing costs can be reduced.

In another aspect of the present teachings, compressors include a piston disposed within a cylinder bore. A wall seals the cylinder bore and is integrally formed with the cylinder block. That is, the wall preferably extends substantially perpendicularly from a side portion of the cylinder block without a seam. Further, the wall may function as a valve plate and thus it is not necessary to prepare an additional valve plate that is separate from the cylinder block. Because the need for a separate valve plate can be eliminated in this embodiment, the number of gaskets can be reduced. Consequently, the number of compressor parts can be reduced compared to known compressors and manufacturing costs can therefore be reduced in this embodiment.

In another aspect of the present teachings, a suction valve and/or a discharge valve may be disposed within the wall. Thus, this embodiment provides a simple configuration for the location of the suction and/or discharge mechanisms. The suction valve and/or the discharge valve may have a large port diameter and a large degree of valve lift. As a result, refrigerant pressure loss during the suction and/or the discharge operations is minimized and an efficient compressor may be realized.

A suction chamber and/or a discharge chamber may be disposed between the wall of the cylinder block and a rear member that seals the rear side of the cylinder block.

For example, a portion may extend toward the rear side of the wall and the adjoining surface of the portion and the rear member may be positioned as far as possible from the cylinder bore. In this case, detrimental effects of the fastening force are prevented from deforming the cylinder bore when the rear member is fastened to the portion of the cylinder block with a fastening bolt. Therefore, refrigerant leakage from such deformation can be prevented and an efficient compressor can be realized in this embodiment as well.

By extending the cylinder block to the rear side of the wall, the suction chamber and/or the discharge chamber can be disposed on the rear side of the wall. Further, the rear member that seals the suction chamber can be fastened to the discharge chamber in a plate-like manner. Consequently, the shape of the rear member can be simplified.

Additional objects, features and advantages of the present invention will be readily understood after reading the following detailed description together with the accompanying drawings and the claims. Because this summary does not describe all features of the present teachings, subcombinations of the features described below may be utilized to realize other aspect of the present teachings.

DETAILED DESCRIPTION OF THE INVENTION

Compressors include, for example, a piston that is reciprocally disposed within a cylinder bore. Reciprocal movement of the piston is utilized to compress a fluid, such as a refrigerant. The cylinder bore is sealed by a wall that is integrally formed with the cylinder block. Preferably, the wall seamlessly extends from a side portion of the cylinder block. The wall may optionally include a suction valve that is adapted to draw the refrigerant. In addition or in the alternative, the wall may include a discharge valve that is adapted to discharge the compressed and highly pressurized refrigerant. Moreover, a rear member may be provided to seal the space on the rear side of the wall. The suction chamber and/or the discharge chamber may be disposed between the wall and the rear member.

Methods for manufacturing compressors are also taught. In one method, the wall may be integrally formed with the cylinder block in order to seal the cylinder bore. Preferably, the wall is formed to extend from a side of the cylinder block without a seam. In another method, a suction valve that is adapted to draw a fluid (refrigerant) may be disposed within the wall. In another method, a discharge valve that is adapted to discharge a compressed and highly pressurized fluid (refrigerant) may also be disposed within the wall. In a further method, a rear member may be utilized to seal the space on the rear side of the wall. The suction chamber and/or the discharge chamber may be disposed between the wall and the rear member.

Additional examples of the present teachings will be described in greater detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the above detail description may not be necessary to practice the invention in the broadest sense, and are instead taught merely to particularly describe some examples of the invention. In addition, the present teachings naturally may be combined in ways that are not specifically enumerated in order to provide additional useful embodiments of the present teachings.

The following detailed embodiment may be utilized as a compressor for an automotive air conditioning system. This compressor may draw, compress, pressurize and discharge a refrigerant. Naturally, other uses of the present compressors are contemplated and other fluids may be utilized instead of a refrigerant.

Figure 1:
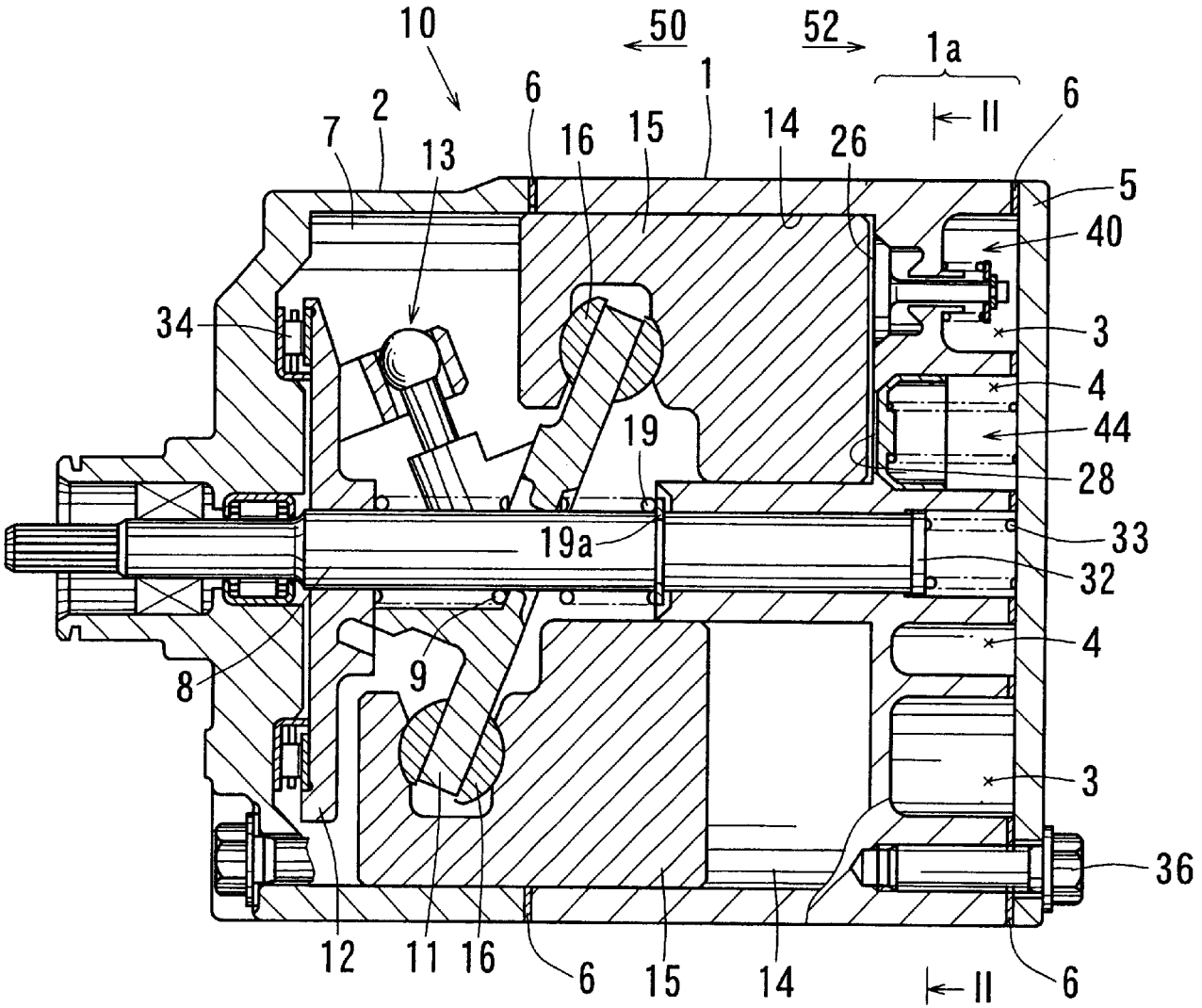
FIG. 1 shows a first variable displacement compressor.

As shown in FIG. 1, as one example of the compressor, a variable displacement compressor 10 (hereinafter referred to as "compressor") may include a cylinder block 1, a front housing 2 fixed to the front end (on the left side of the figure) of the cylinder block 1. A rear plate 5 is fastened to the rear end (on the right side of the figure) of the cylinder block 1 using a fastening bolt 36. A gasket 6 may seal the refrigerant within a suction chamber 3 and the gasket 6 can be disposed between the attaching surfaces. The rear plate 5 is one part that may be utilized as a "rear member" of the present teachings.

A drive shaft 8 transmits rotation from a drive source to a swash plate 11 and is inserted through the cylinder block 1 and the front housing 2. Naturally, the drive shaft 8 is rotatably supported within the cylinder block 1. A thrust race 32 and a spring member 33 adapted to urge or bias the rear end of the drive shaft 8 forward (toward the side of the front housing 2) are disposed on the interior side of the rear plate 5. The elastic urging force of the spring member 33 is supported by a thrust bearing 34 disposed between a rotor 12 and the front housing 2.

A disk-like swash plate 11 is disposed within a crank chamber 7 of the front housing 2. The swash plate 11 is coupled to a drive shaft 8 and may rotate together with the drive shaft 8. The swash plate 11 is slidably and inclinably supported by the drive shaft 8 in the axial direction thereof. The rotor 12 is fastened to the drive shaft 8. The rotor 12 integrally rotates with the swash plate 11 via a hinge mechanism 13 to transmit the torque of the drive shaft 8 to the swash plate 11. The rotor 12 allows the swash plate 11 to rotate at various inclination angles.

Balancing springs 9 and 19 are located along the axial circumference of the drive shaft 8 near the swash plate 11. The swash plate 11 and the rotor 12 accept the ends of the balancing spring 9, respectively. The swash plate 11 and a circlip 19*a* accept the ends of the balancing spring 19, respectively. Therefore, the swash plate 11 is pushed in the axial direction of the drive shaft 8 and is held in a designated position (e.g., a position slightly inclined in relation to the drive shaft 8) as a result of the balance between springs 9 and 19 when the compressor 10 is not operating.

Three cylinder bores 14 may be arranged at constant angular intervals around the drive shaft 8. A piston 15 is slidably disposed within each cylinder bore 14. The rear face of each piston 15 is connected to the swash plate 11 via shoes 16. Therefore, when the swash plate 11 rotates together with the rotation of the drive shaft 8, each piston 15 reciprocates within its respective cylinder bore 14 in the directions shown by arrows 50 and 52 shown in FIG. 1 together with the rotational movement. The reciprocating pistons 15 causes, for example, the refrigerant to be drawn into a cylinder bore 14 (i.e. a suction step). Thereafter, a compressed refrigerant is discharged from the cylinder bore 14 after pressurization (i.e. a discharge step).

The discharge capacity of the compressor 10 is determined according to the stroke length (i.e. the distance from the upper dead center to the lower dead center) of the piston 15. The stroke length of the piston 15 is determined by the inclination angle of the swash plate 11 with respect to a plane perpendicular to the axis of the drive shaft 8. More specifically, the stroke length of the pistons 15 and the discharge capacity increase as the inclination angle of the swash plate 11 increases. On the other hand, the stroke length of the pistons 15 and the discharge capacity decrease as the inclination angle of the swash plate 11 decreases. The inclination angle of the swash plate 11 during operation of the compressor is determined by the pressure difference between the inside of the cylinder bore 14 and the inside of the crank chamber 7. The pressure difference can be adjusted, for example, by releasing the compressed high-pressure refrigerant into the crank chamber 7 by means of a capacity control valve (not shown).

Figure 2:
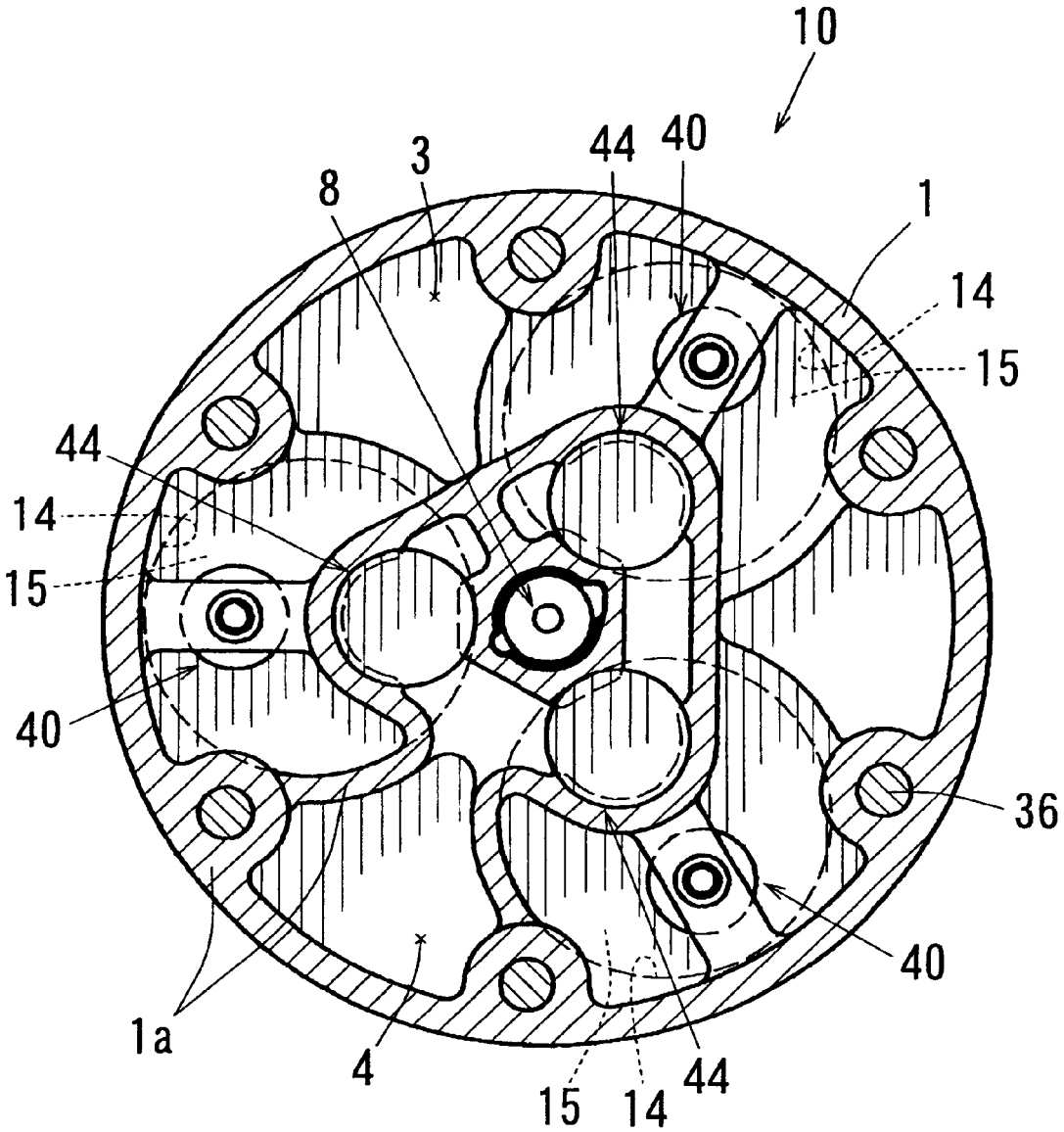
FIG. 2 shows a cross section along line II—II in FIG. 1.

As is shown in FIGS. 1 and 2, a wall 1*a* integrally formed with the cylinder block 1 seals the cylinder bores 14. The wall 1*a* includes a parallel portion that extends substantially in a parallel direction with respect to the side portion of the cylinder block 1 towards the rear side of the cylinder block 1. The wall 1*a* also includes a perpendicular portion that extends substantially in a perpendicular direction with respect to the side portion of cylinder block 1. Preferably, the wall 1*a* is integral with the cylinder block 1. Thus, there are no seams between the wall 1*a* and the cylinder block 1 and it is not necessary to connect a valve plate to the cylinder block 1 using a gasket and fastening bolts.

The plate-shaped rear plate 5 is fastened to the parallel portion via the gasket 6. Suction valves 40 adapted to draw a refrigerant and discharge valves 44 adapted to discharge the compressed refrigerant are disposed within the wall 1*a* at locations corresponding to each piston 15. The wall 1*a* and the rear plate 5 enclose a suction chamber 3 and a discharge chamber 4. A suction port 26 communicates with the suction chamber 3 via suction valves 40. A discharge port 28 communicates with the discharge chamber 4 via discharge valves 44.

The construction and operation of suction valves 40 and discharge valves 44 will be described with reference to FIG. 3. Suction valves 40 may, for example, comprise a valve stem member 42 and a spring member 43 that elastically urges the valve stem member 42 in the direction of arrow 56 shown in FIG. 3. The valve stem member 42 comprises a valve body 41*a* that seals the suction port 26 and a cylindrically shaped support part 41*b* that supports the valve body 41*a*. An insertion hole 47 is formed in the wall 1*a* and the support part 41*b* of the valve stem member 42 can be inserted into the insertion hole 47.

When the piston 15 moves in the direction of arrow 54 shown in FIG. 3 and the pressure in the cylinder bore 14 drops below the pressure of the suction chamber 3 during the suction step, the valve stem member 42 moves in the direction of arrow 54 against the elastic urging force of the spring member 43. Thus, the seal is broken between the suction port 26 and the valve body 41*a* and the refrigerant disposed within the suction chamber 3 is drawn into the cylinder bore 14 via suction valves 40. On the other hand, when the pressure in the cylinder bore 14 rises above the pressure of the suction chamber 3 during the discharge step, the valve stem member 42 moves in the direction of arrow 56 shown in FIG. 3 due to the elastic urging force of the spring member 43. Therefore, the valve body 41*a* will again seal the suction port 26.

Discharge valves 44 may, for example, comprise a valve member 45 that seals the discharge port 28 and a spring member 46 that elastically urges the valve member 45 in the direction of arrow 54. An insertion hole 48 is formed in the wall 1*a* and the valve member 45 can be inserted into insertion hole 48. Therefore, when the pressure in the cylinder bore 14 rises above the pressure of the suction chamber 3 during the discharge step, the valve member 45 moves in the direction of arrow 56 against the elastic urging force of the spring member 46. The seal of the discharge port 28 is broken due to the valve member 45 and the compressed refrigerant in the cylinder bore 14 is discharged into the discharge chamber 4 via discharge valves 44. On the other hand, when the pressure in the cylinder bore 14 drops below the pressure of the suction chamber 3 during the suction step, the valve member 45 moves in the direction of arrow 54 due to the elastic urging force of the spring member 46 and the discharge port 28 is sealed by the valve member 45.

Figure 3:
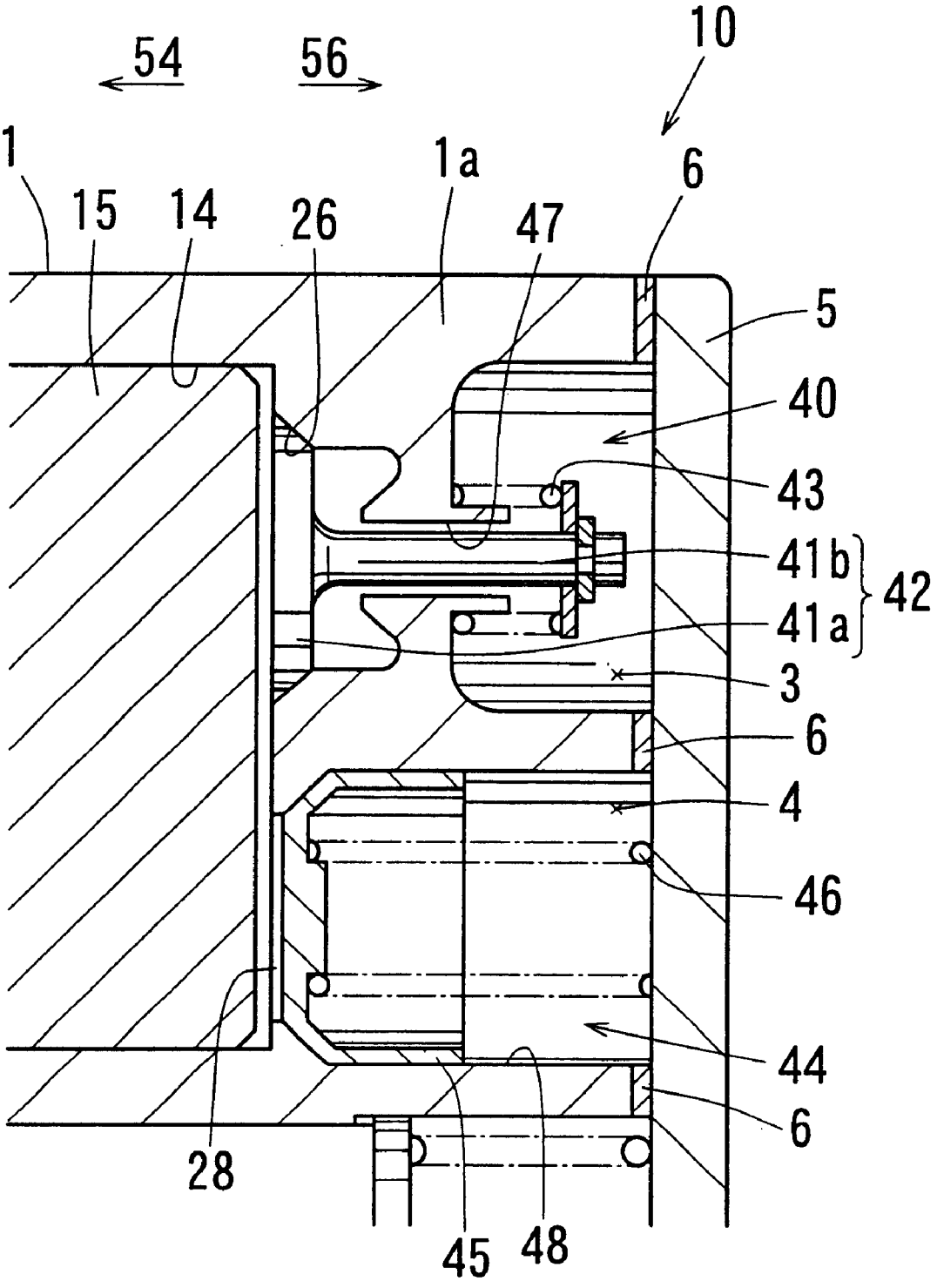
FIG. 3 shows a partially expanded view of FIG. 1.

By using suction valves 40 and discharge valves 44 having the constructions shown in FIG. 3, the diameters of the suction port 26 and the discharge port 28 can be made relatively large and the valve lift amount can also be made relatively large. Therefore, pressure loss of the refrigerant during the suction step or the discharge step is minimized.

According to the variable displacement compressor 10 of the first embodiment, the wall 1*a* that seals the cylinder bore 14 is integrally formed with the cylinder block 1. Therefore, the wall 1*a* performs the valve-plate function of known compressors. Because one adjoining surface on the rear side of the cylinder block 1 with the rear plate 5 is sufficient, a limited number of gaskets may be utilized to attach the joining parts. Therefore, the number of parts of the compressor 10 is reduced and the production cost is reduced.

Because suction valves 40 and discharge valves 44 are disposed within the wall 1*a* that is integrally formed with the cylinder block 1, the valve plate of known compressors is not necessary with the first embodiment. Furthermore, the locations of the suction and discharge mechanisms can be configured relatively simply.

Suction valves 40 and discharge valves 44 preferably provide a large port diameter and a large valve lift amount. Thus, fluid pressure loss of the refrigerant during the suction or the discharge steps is minimized.

A parallel portion of the wall 1*a* extends toward the rear side substantially in parallel with a side of the cylinder block 1. Also, the rear plate 5 is fastened to the cylinder block 1 at a position separated from the cylinder bore 14. Thus, deformities to the cylinder bore 14 caused by fastening attaching bolts may be minimized and leakage of the refrigerant due to such deformities can be prevented. The rear plate 5 may have a plate-like configuration because the rear plate 5 is fastened to the parallel portion (i.e. the portion extends from the wall 1*a* towards the rear side of the cylinder block 1).

Naturally, the present teachings are not limited to the first embodiment and a variety of applications and modifications are contemplated. For example, although the first embodiment utilizes suction valves 40 and discharge valves 44 that are disposed within the wall 1*a*, the valve constructions are not limited and various modifications are possible. Therefore, a second embodiment of the teachings will be described with reference to FIG. 4.

Figure 4:
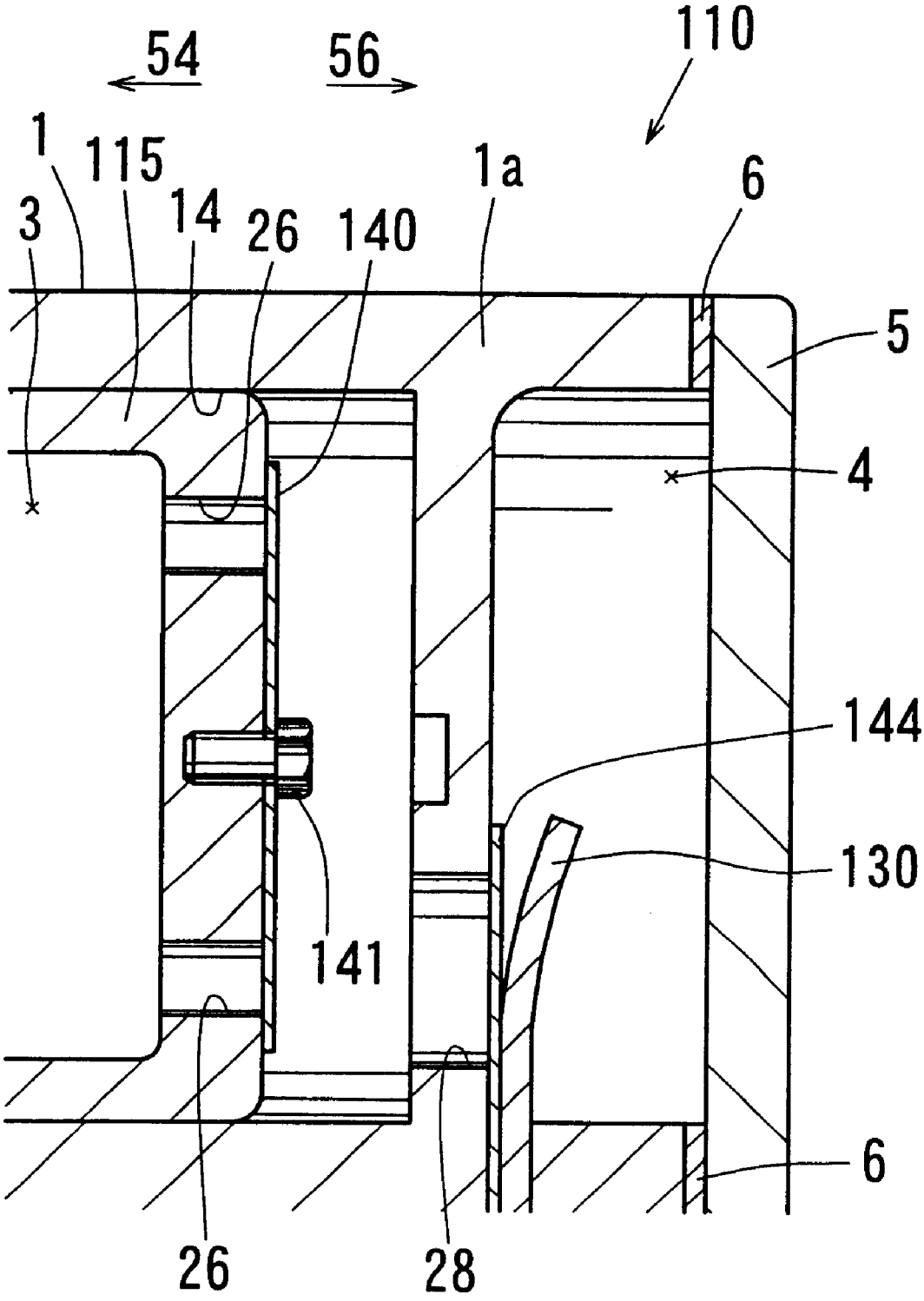
FIG. 4 shows a valve mechanism of a second variable displacement compressor.

As shown in FIG. 4, a compressor 110 comprises a suction port 26 on a head surface (on the right edge of FIG. 4) of a piston 115 and the suction port 26 may include a hovering portion that partially defines the suction chamber 3. A suction valve 140 is attached at a location corresponding to a suction port 26 of the head surface of the piston 115 by a fastener 141. The discharge port 28 is provided in the wall 1*a*. Further, a discharge valve (lead valve) 144 and a valve retainer 130 are attached at a location corresponding to the discharge port 28. Therefore, when piston 115 moves in the direction of arrow 54 shown in FIG. 4 and the pressure in cylinder bore 14 drops below the pressure of the suction chamber 3 during the suction step, the seal of the suction port 26 is broken due to the suction valve 140. Therefore, the refrigerant disposed within the suction chamber 3 is drawn into the cylinder bore 14 through the suction port 26. Because the pressure in cylinder bore 14 is less than the pressure in the discharge chamber 4 at this time, the discharge port 28 is sealed by the discharge valve 144.

When the piston 115 moves in the direction of arrow 56 and the pressure in the cylinder bore 14 rises above the pressure of the suction chamber 3 during the discharge step, the suction port 26 is sealed by the suction valve 140. Because the pressure in the cylinder bore 14 is greater than the pressure in the discharge chamber 4 at this time, the seal of the discharge port 28 is broken due to the discharge valve 144.

Naturally, a variety of modifications to such a compressor comprising the wall 1*a* that seals the cylinder bores 14 are contemplated. For example, various types of suction valves and discharge valves, as well as valve constructions, may be utilized. In the second embodiment, suction valves 40 and discharge valves 44 are disposed within the wall 1*a* on the rear side of the cylinder block 1. However, suction valves 40 and discharge valves 44 may be disposed in a variety of positions.

Further, while the above discussion primarily describes a variable displacement compressor, the present teachings may be applied to other types of compressors. For example, the present teachings may be applied to fixed-capacity compressors. Moreover, the shape of the rear plate 5 is not limited and may be modified in a variety of ways according to its relationship with the shape of the wall 1*a*. Further, although three cylinder bores 14 and three pistons 15 and suction valves 40 and discharge valves 44 corresponding to each cylinder bore 14 were described above, the number and arrangement of cylinder bores, pistons, suction valves, discharge valves, and other parts are not limited, and a variety of modifications according to necessity are possible.

What is claimed is:

1. A compressor comprising:

a cylinder block having a cylinder bore defined therein, the cylinder block including a side portion and a wall, the side portion opposing the cylinder bore in a diametrical direction of the cylinder bore, the wall opposing the cylinder bore in an axial direction of the cylinder bore and including a perpendicular portion and a parallel portion, wherein the perpendicular portion extends substantially perpendicular to the side portion of the cylinder block so as to substantially enclose the cylinder bore, and the parallel portion is formed continuously with the perpendicular portion and extends from the perpendicular portion in a direction that is substantially parallel with the side portion and spaced from the cylinder bore;

a piston disposed within the cylinder bore and arranged and constructed to reciprocate so as to compress a fluid within the cylinder bore;

a suction port and a discharge port defined within the perpendicular portion of the wall and communicating with the cylinder bore;

a suction chamber defined within the perpendicular portion of the wall and communicating with the suction port;

a discharge chamber defined within the perpendicular portion of the wall and communicating with the discharge port;

a suction valve disposed within the perpendicular portion and arranged and constructed to open and close the suction port;

a discharge valve disposed within the perpendicular portion and arranged and constructed to open and close the discharge port, whereby the compressed fluid is drawn from the suction chamber into the cylinder bore via the suction port and the suction valve and is discharged from the cylinder bore to the discharge chamber via the discharge port and the discharge valve;

a rear member substantially sealingly attached to the parallel portion of the wall in a position opposite to the cylinder bore; and a tightening device fastening the rear member against the parallel portion of the wall, wherein the suction chamber and the discharge chamber are defined separately within the parallel portion and are disposed between the perpendicular portion and the rear member, and the parallel portion encloses the suction chamber and the discharge chamber.

2. A compressor as in claim 1, wherein the rear member comprises a rear plate.

3. A compressor as in claim 1, wherein the tightening device comprises a bolt that extends through the rear member and the parallel portion of the wall.

4. A compressor as in claim 1, wherein the suction valve and the discharge valve each include a valve member that is arranged and constructed to move along an axial direction that is substantially parallel to the parallel portion.

5. A compressor as in claim 4, wherein the perpendicular portion of the wall includes support portions that support the valve members, and wherein the valve members are arranged and constructed to slide along the axial directions of the respective support portions.

* * * * *